US007963263B2

(12) United States Patent
Anderson et al.

(10) Patent No.: US 7,963,263 B2
(45) Date of Patent: Jun. 21, 2011

(54) SPARK IGNITION DEVICE FOR INTERNAL COMBUSTION ENGINE

(76) Inventors: Gerald B. Anderson, Westminster, CA (US); Rene Jimenez, Laguna Hills, CA (US)

( * ) Notice: Subject to any disclaimer, the term of this patent is extended or adjusted under 35 U.S.C. 154(b) by 134 days.

(21) Appl. No.: 12/386,007

(22) Filed: Apr. 13, 2009

(65) Prior Publication Data

US 2010/0258072 A1 Oct. 14, 2010

(51) Int. Cl.
*H01T 13/05* (2006.01)
*F02P 3/02* (2006.01)

(52) U.S. Cl. ..... 123/143 C; 123/620; 123/647

(58) Field of Classification Search ..... 123/143 C, 123/620, 647
See application file for complete search history.

(56) References Cited

U.S. PATENT DOCUMENTS

| | | | | |
|---|---|---|---|---|
| 4,269,160 | A * | 5/1981 | Irvin, Jr. | 123/620 |
| 4,758,791 | A * | 7/1988 | Tedeschi et al. | 324/402 |
| 5,596,974 | A * | 1/1997 | Hall et al. | 123/620 |
| 6,089,214 | A * | 7/2000 | Anderson | 123/620 |
| 6,796,298 | B1 * | 9/2004 | Kiker | 123/620 |

* cited by examiner

*Primary Examiner* — Willis R Wolfe, Jr.
(74) *Attorney, Agent, or Firm* — Edward E. Roberts

(57) ABSTRACT

An engine spark ignition device for internal combustion engines having electrical coupling of the firing spark plug wire to the non-firing spark plug wires. The device is for use with an engine having a plurality of spark plug wires connected between a distributor and a spark plug disposed in the engine cylinder and comprises identical elongated electrically conductive semi-circular plates which enclose identical elongated electrically conductive planar plates having apertures therein that intersect to form spaces for receiving the spark plug wires. The interaction between firing spark plug wires and non-firing spark plug wires results in more efficient and cleaner combustion in the combustion chambers.

9 Claims, 3 Drawing Sheets

SPARK IGNITION DEVICE FOR INTERNAL COMBUSTION ENGINE

BACKGROUND

The background of the invention will be discussed in two parts.

Field of the Invention

The invention relates to new spark ignition device for internal combustion engines and particularly to a device providing for cleaner and more efficient combustion in the combustion chamber.

Description of the Related Art

Means for improving combustion in the cylinders of an internal combustion engine, by ionizing the gases in the cylinders thereby breaking down hydrocarbon molecules for more efficient burning, is known in the art. It is known that a non-igniting condition produced by an electrostatic charge can be developed in each of the non-firing cylinders of the internal combustion engine responsive to the flow of current to the firing cylinder through the firing spark plug wire. The current flow induced in the non-firing spark plugs improves the combustibility of the fuel/air mixture in the cylinders by ionizing the gases in the cylinders.

One device which has been utilized to create this non-igniting condition is disclosed in U.S. Pat. No. 4,269,160 issued to Irvin, Jr. The device includes a plurality of induction blocks having a longitudinal channel sized to receive a spark plug wire. Current flowing to each firing cylinder of the engine induces an electrical potential in a pair of plates disposed in the induction block on the firing wire. This potential in the plates of the induction block is communicated to corresponding plates of the other induction blocks on the non-firing spark plug wires inducing an electrostatic potential on the plates around the non-firing spark plug wires to thereby communicate the electrical potential into the non-firing cylinders.

Another such device is disclosed in U.S. Pat. No. 3,949,718 issued to Turner. This device discloses a corona coupling system having a plurality of corona coupling unit blocks which are individually snapped on the spark plug wires of the ignition system of an internal combustion engine. The blocks are interconnected by means of two generally parallel, insulated wires clamped in place and running through each block. A stamped conductive plate is positioned in each block and is electrically connected to the insulated wires. The successively built up and collapsing lines of force result in inductive buildup of voltage levels in the corona coupler to very high levels.

Yet another such device is disclosed in U.S. Pat. No. 6,089,214 issued to Anderson which discloses an engine spark ignition system electrical coupler for capacitive coupling of the non-firing spark plug wires, and thereby the non-firing spark plugs, to the firing spark plug wire.

While these devices fulfill their respective, particular objectives and requirements, it is an object of the present invention to provide a new engine spark ignition system apparatus wherein the electrical charge of a firing spark plug is electrically coupled to the non-firing spark plug wires resulting in more complete and thus cleaner burning in the combustion chamber. Other aspects, features and advantages of the invention will become apparent from a reading of the specification, when taken in conjunction with the drawings, in which like reference numerals refer to like elements in the several views.

SUMMARY

There is provided a new engine spark ignition coupler apparatus for internal combustion engines having novel features that result in a new and improved engine spark ignition system wherein the interaction between firing spark plug wires and non-firing spark plug wires results in more efficient and cleaner combustion in the combustion chambers. The system is for use with an engine having a plurality of spark plug wires connected between a distributor and a spark plug disposed in the engine cylinder. The present invention comprises an elongated tubular electrically conductive member enclosing electrically conductive plates that form spaces for receiving spark plug wires.

DRAWINGS

DESCRIPTION

Figure 1:
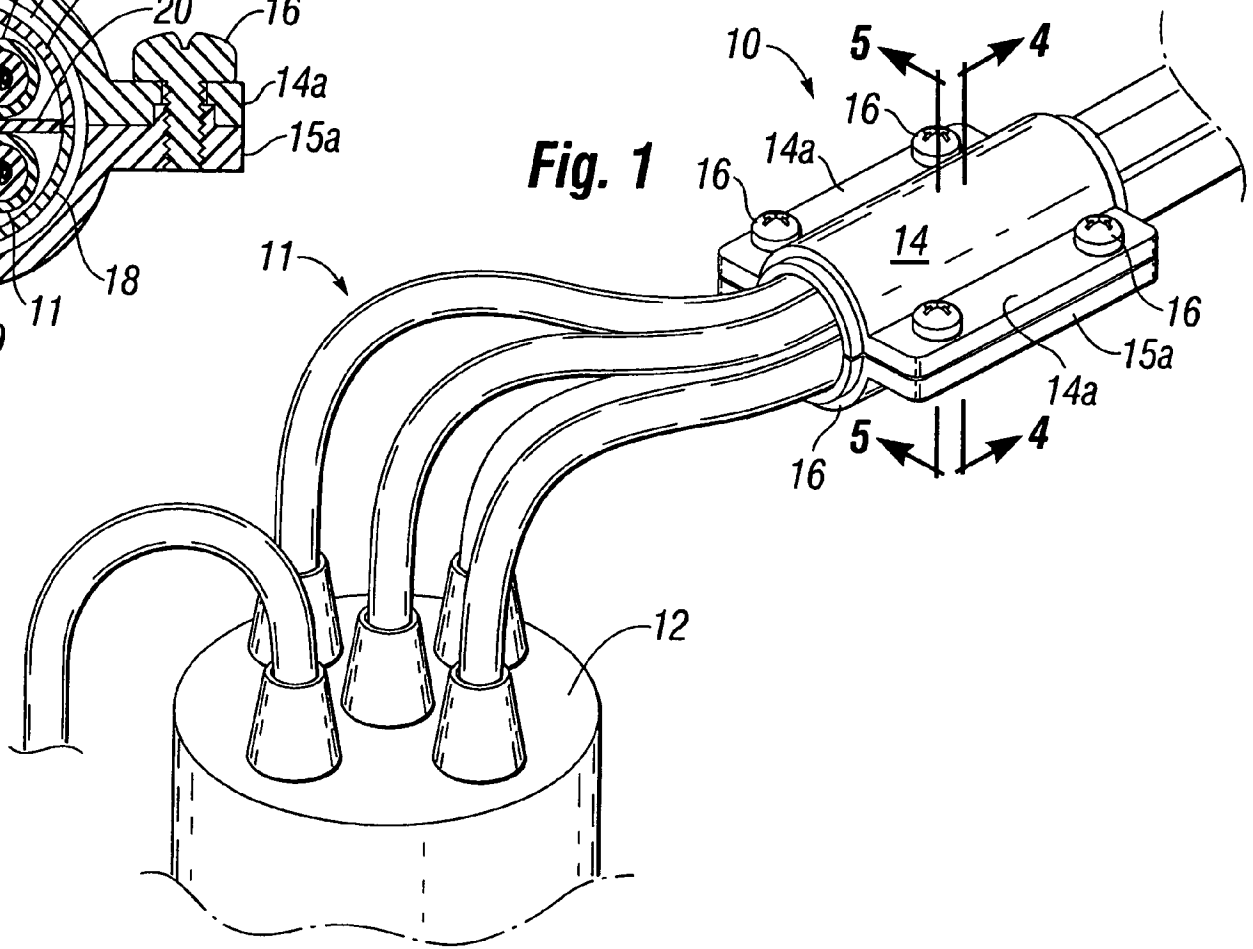
FIG. 1 is perspective view of the present invention in use with a distributor cap of a four cylinder internal combustion engine.

The present invention relates to a novel spark ignition device for use with internal combustion engines wherein the interaction between firing spark plug wires and non-firing spark plug wires results in more efficient and cleaner combustion in the combustion chambers, that is, the current through the firing spark plug wires induces a current through the non-firing spark plug wires to provide in each of the non-firing cylinders a non-igniting condition produced by an electrostatic charge responsive to the flow of current to the firing cylinder through the firing spark plug wire. This improves the combustibility of the fuel/air mixture in the cylinders by ionizing the gases in the cylinders. The device is connected in a physically non-invasive manner to the spark plug wires between the distributor and the spark plugs. As described, the device provides more complete and efficient burning of combustion gases which results in increased fuel efficiency and engine power which in turn contribute to increased engine and spark plug life. The more complete burning also results in decreased pollutants, a major environmental concern.

It is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. Further, variations in size, materials, shape, form, function and manner of operation, assembly and use, are deemed readily apparent and obvious to one skilled in the art, and all equivalent relationships to those illustrated in the drawings and described in the specification are encompassed by the present invention.

With reference to the drawings, FIG. 1 is a perspective view of spark ignition device, generally designated by the reference numeral 10, in use with four spark plug wires 11 and distributor 12 of a four cylinder internal combustion engine. As indicated, the spark ignition device 10 is banded about the spark plug wires 11 between the distributor 12 and the spark plugs (not shown). The device 10 comprises two substantially identical elongated semi-circular non-conductive cover members, a top member 14 and a mating bottom member 15 which when mated, as will be described, form a tubular configuration. Cover members 14 and 15 are shown to include, one on each side, outwardly extending shoulders 14*a* and 15*a*, respectively, for receiving fasteners 16 to clamp members 14 and 15 about spark plug wires 11 in abutting and matching relationship. It is understood that members 14 and 15 could be mated by means other than as shown, such as with glue, in which case shoulders 14*a* and 15*a* would not be included.

Figure 4:
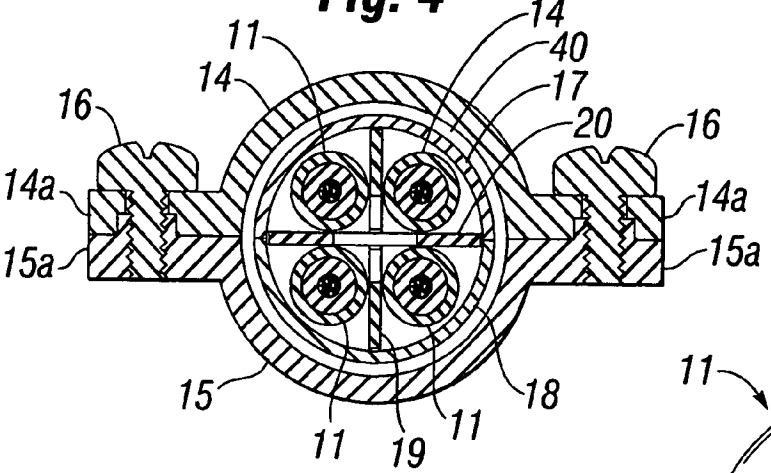
FIG. 4 is cross-sectional view taken along lines 4-4 of FIG. 1.
Figure 2:
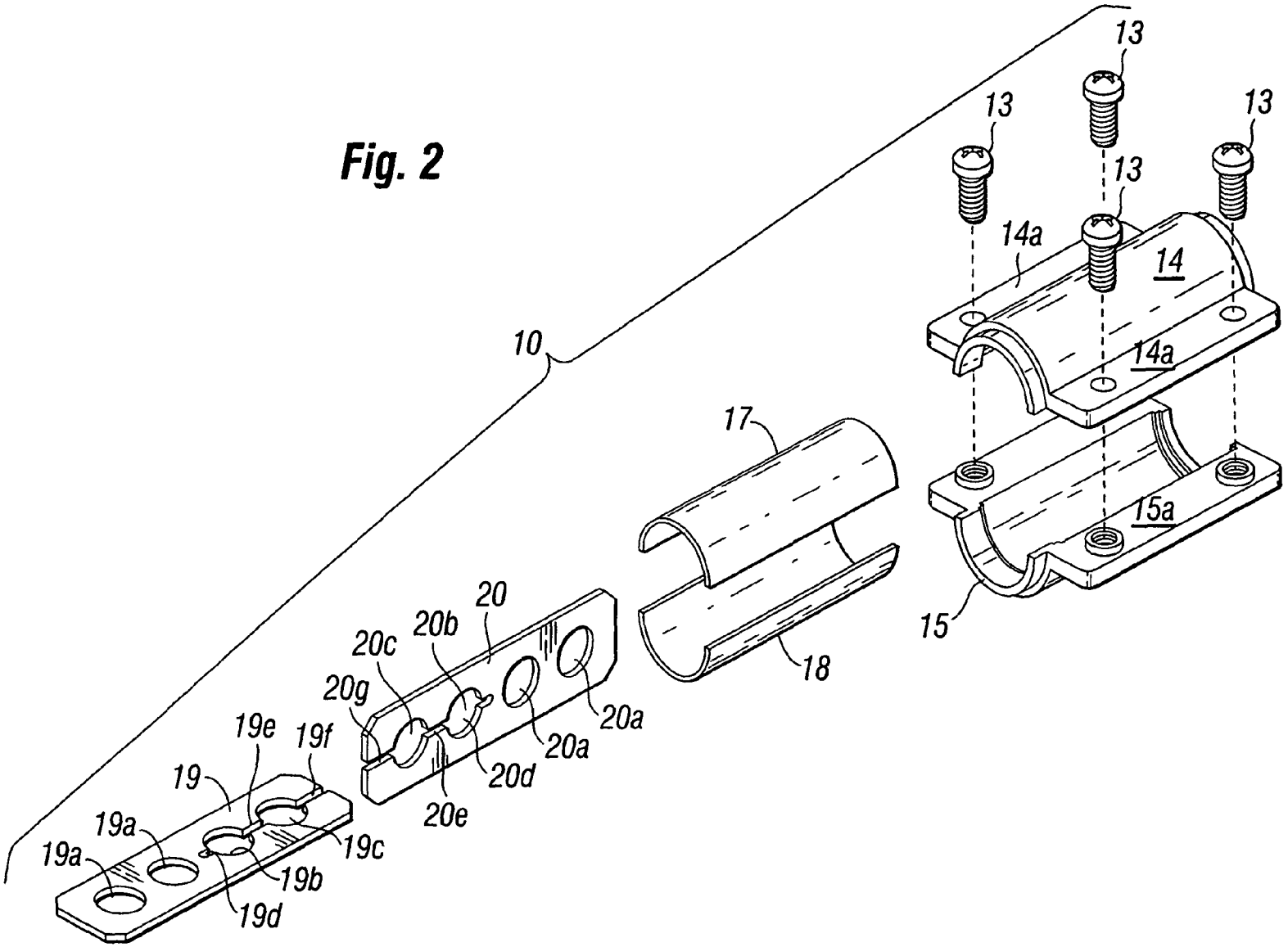
FIG. 2 is an exploded isometric illustration in accordance with the invention.

FIG. 2 is an exploded isometric view of the ignition device 10 in accordance with the invention. The cover members 14 and 15, as also seen in FIG. 4, enclose two identical elongated electrically conductive semi-circular plates 17 and 18 which further enclose identical elongated electrically conductive planar plates 19 and 20. Planar plates 19 and 20 have disposed laterally therethrough respective in-line spaced apertures 19*a* (two shown), 20*a* (two shown); 19*b*, 20*b*; 19*c*, 20*c*; 19*d*, 20*d*; 19*e*, 20*e*; and 19*f*, 20*f*. Apertures 19*a* and 20*a* are located in-line and sequentially from a first end of planar plates 19 and 20 respectfully, and are followed sequentially by apertures 19*b*, 19*c* and 20*b*, 20*c*, respectively. Apertures 19*b* and 20*b* have centrally located in-line notches 19*d* and 20*d*, respectively, on the sides adjacent to apertures 19*a*, 20*a*, respectively, and centrally located in-line channels 19*e*, 20*e* connecting to apertures 19*c*, 20*c*, respectively. Apertures 19*c*, 20*c* have centrally located in-line channels connecting apertures 19*c*, 20*c* to provide respective openings from the second end of plates 19 and 20, respectively. The four apertures in plates 19 and 20 are shown as circular but this is not intended to be limiting in that a different number of apertures having different configurations could be used in accordance with the invention.

Figure 3:
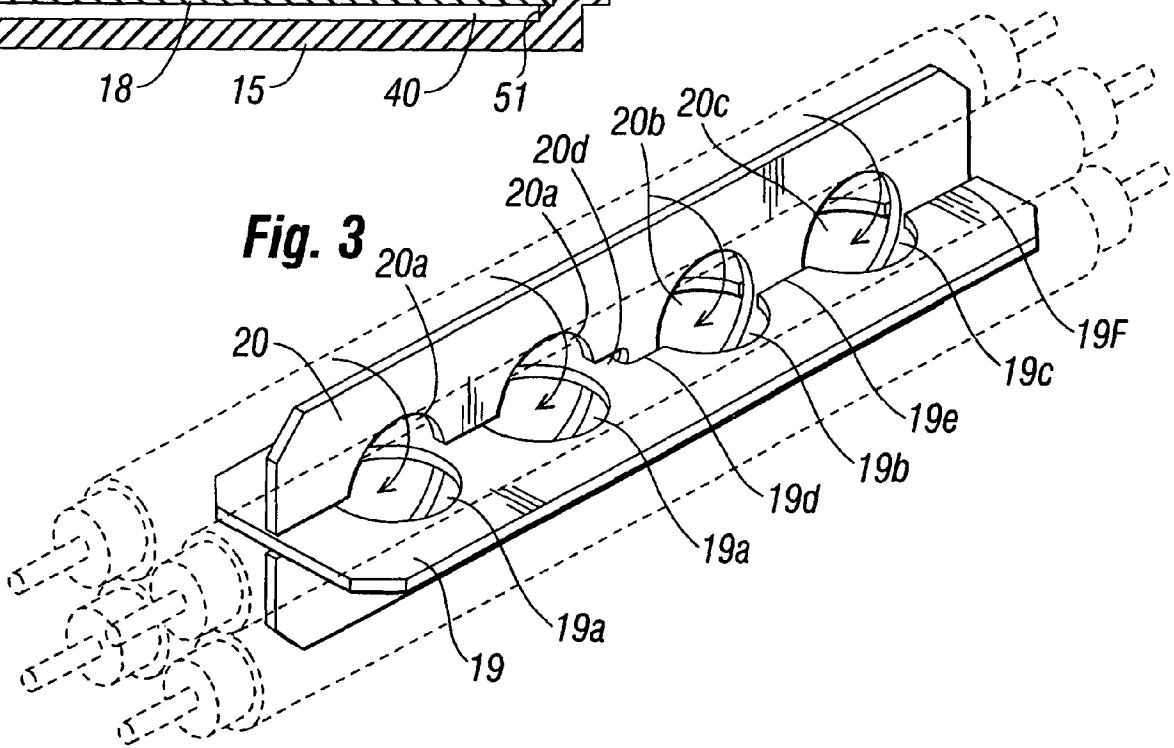
FIG. 3 is a perspective view of the plates of FIG. 2 assembled in accordance with the invention.

FIG. 3 is a perspective view of the planar plates of FIG. 2 assembled in accordance with the invention. This assembly is accomplished by orienting the plates as indicated in FIG. 2 and then fully sliding plate 19 fully into plate 20 so that notch 19*d* of plate 19 fully engages notch 20*d* of plate 20. In this manner plates 19 and 20 are oriented at right angles to form four quadrants, one each to receive, as shown in dotted lines, a respective spark plug wire. With the full insertion of plate 19 into plate 20 apertures 19*a* line up with apertures 20*a*, aperture 19*b* lines up with aperture 20*b* and aperture 19*c* lines up with aperture 20*c*, With this alignment of circular apertures there is provided four identical continuous spherical, or toroidal pathways, as indicated by the arrows, through the electrically conductive plates 19 and 20. That is, the circular surfaces if rotated about their axis, would establish an outside pathway in the form of a torus. Put another way, if the fully engaged plates 19 and 20 were rotated about their longitudinal axis the circular apertures would trace out a torus.

FIG. 4 is cross-sectional view taken along lines 4-4 of FIG. 1 that illustrates the respective positioning of the components of the invention. As seen, spark plug wires 11 are positioned one each in a respective quadrant formed by the intersection of plates 19 and 20, the ends of plate 19 contact semicircular plates 17 and 18 at the centers thereof and the ends of plate 20 contacts plates 17 and 18 at their intersection points. Semicircular plates 17 and 18 are separated from cover members 14 and 15 (see FIG. 5) to form a space 40 as further shown and discussed in FIG. 5.

Figure 5:
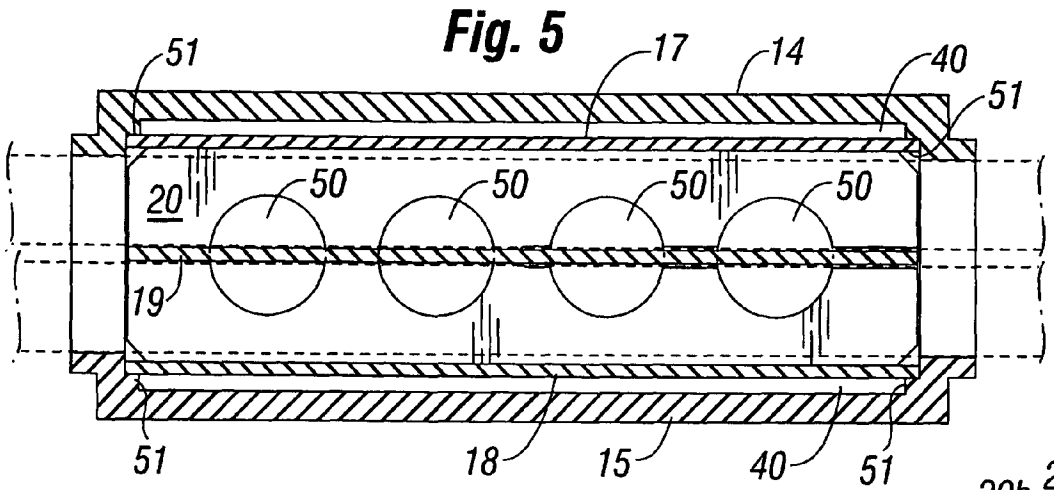
FIG. 5 is cross-sectional view taken along lines 5-5 of FIG. 1.

FIG. 5 is cross-sectional view taken along lines 5-5 of FIG. 1 that illustrate circular spherical or pathways 50 when the ignition device 10 is fully assembled. That is, as previously mentioned, the circular surfaces of pathways 50 if rotated about their axis, would establish a pathway in the form of a torus. Also shown are shoulders 51 supporting plates 17 and 18 to provide space 40.

Those skilled in the art will appreciate that the conception, upon which this disclosure is based, may readily be utilized as a basis for the designing of other structures, methods and systems for carrying out the several purposes of the present invention. Therefore, the foregoing is considered as illustrative only of the principles of the invention. Further, since numerous modifications and changes will readily occur to those skilled in the art, it is not desired to limit the invention to the exact construction and operation shown and described. Therefore, the foregoing is considered as illustrative only of the principles of the invention. Further, since numerous modifications and changes will readily occur to those skilled in the art, it is not desired to limit the invention to the exact construction and operation shown and described.

What is claimed is:

1. A spark ignition device for internal combustion engines that is attached to a plurality of spark plug wires between the distributor and the spark plugs, the device comprising:

an electrically conductive member;

electrically conductive means inserted in electrical contact within said electrically conductive member;

said electrically conductive means configured to form longitudinal spaces, each receiving a selected spark plug wire, said spaces formed by engaged electrically conductive longitudinal planar plates each including aligned apertures providing for electrical coupling of said spark plug wires;

non-conductive cover means for encompassing the combination of said electrically conductive member and said electrically conductive means; and wherein the electrical interaction between firing spark plug wires and non-firing spark plug wires results in more efficient and cleaner combustion in the combustion chambers.

2. The spark ignition device of claim 1 wherein said electrically conductive means is configured to form four longitudinal spaces, each receiving a selected one of four spark plug wires, said spaces formed by electrically conductive longitudinal planar plates engaged to form longitudinal quadrants.

3. A spark ignition device for internal combustion engines that is attached to a plurality of spark plug wires between the distributor and the spark plugs, the device comprising:

an electrically conductive member;

electrically conductive means inserted in electrical contact within said electrically conductive member;

said conductive means including spaces for receiving a selected spark plug wire in a selected space and having aperture means for inducing electrical coupling of the spark plug wires;

said conductive member is generally tubular and longitudinally elongated and said conductive means includes elongated electrically conductive plates forming said spaces for receiving a selected spark plug wire in a selected space;

said spaces are formed by engaged longitudinal electrically conductive planar plates having said aperture means aligned longitudinally thereon:

non-conductive cover means for encompassing the combination of said electrically conductive member and said electrically conductive means; and wherein the electrical interaction between firing spark plug wires and non-firing spark plug wires results in more efficient and cleaner combustion in the combustion chambers.

4. The spark ignition device of claim 3 wherein said electrically conductive means is configured to form four longitudinal spaces, each receiving a selected one of four spark plug wires, said spaces formed by electrically conductive longitudinal planar plates engaged to form longitudinal quadrants, said plates each including aligned apertures providing for electrical coupling of said spark plug wires.

5. The spark ignition device of claim 4 wherein said aperture means are circular and aligned in a manner to trace out a torus when said plates are spatially rotated about their longitudinal axis.

6. A spark ignition device for internal combustion engines that is attached to a plurality of spark plug wires between the distributor and the spark plugs, the device comprising:

an elongated tubular electrically conductive member;

elongated electrically conductive means for insertion within said tubular member in electrically conductive contact, said conductive means for insertion including longitudinal spaces for receiving a selected spark plug wire in a selected space;

said conductive means for insertion within said tubular member including aperture means providing for electrical coupling of the spark plug wires whereby non-firing spark plug wires are electrically coupled to a firing spark plug; and said spaces are formed by engaged longitudinal electrically conductive planar plates having said aperture means aligned longitudinally thereon.

7. A spark ignition device for internal combustion engines that is attached to a plurality of spark plug wires between the distributor and the spark plugs, the device comprising:

an elongated tubular electrically conductive member;

elongated electrically conductive means for insertion within said tubular member in electrically conductive contact, said conductive means for insertion including longitudinal spaces for receiving a selected spark plug wire in a selected space;

said conductive means for insertion within said tubular member including aperture means providing for electrical coupling of the spark plug wires whereby non-firing spark plug wires are electrically coupled to a firing spark plug; and wherein said electrically conductive means is configured to form four longitudinal spaces, each receiving a selected one of four spark plug wires, said spaces formed by electrically conductive longitudinal planar plates engaged to form longitudinal quadrants, said plates each including aligned apertures providing for electrical coupling of said spark plug wires.

8. The spark ignition device of claim 7 including electrically non-conductive cover means for encompassing the combination of said tubular member and said electrically conductive means.

9. The spark ignition device of claim 7 wherein said aperture means are circular and aligned in a manner to trace out a torus when said plates are spatially rotated about their longitudinal axis.

* * * * *